US005972025A

United States Patent [19]

Taysom

[11] Patent Number: 5,972,025

[45] Date of Patent: Oct. 26, 1999

[54] AIR RESPONSIVE ILLUMINATED PACIFIER

[76] Inventor: Brad Taysom, 10030 N. 5422 W., Highland, Utah 84003

[21] Appl. No.: 08/775,727

[22] Filed: Dec. 31, 1996

[51] Int. Cl.[6] ..... A61J 17/00

[52] U.S. Cl. ..... 606/234; 606/236

[58] Field of Search ..... 606/234, 236, 606/235, 30, 42, 2

[56] References Cited

U.S. PATENT DOCUMENTS

| | | | |
|---|---|---|---|
| 5,540,719 | 7/1996 | Covelli-Ingwell et al. | 606/234 |
| 5,611,622 | 3/1997 | Wang | 606/234 |

*Primary Examiner*—Michael Buiz
*Assistant Examiner*—Kevin Truong

[57] ABSTRACT

A new Air Responsive Illuminated Pacifier for providing a pacifier having a light source which is activated when an child sucks on the pacifier. The inventive device includes an airtight nipple portion, a handle portion attached to the nipple portion, and a light source and a pressure actuated switch positioned within the handle portion, wherein the switch activates the light source when a child sucks on the nipple portion. A single activation of the light source causes the light source to remain lit for a predetermined time (e.g., 15 seconds). When activated, the light source emits light into a hollow interior cavity of the handle portion. The handle portion is made of a translucent or luminescent material. When the handle portion is made of a luminescent material, the handle portion continues to glow for a substantial time after extinguishment of the light source, thereby enabling a child or parent to easily locate the pacifier in the dark.

15 Claims, 3 Drawing Sheets

AIR RESPONSIVE ILLUMINATED PACIFIER

BACKGROUND OF THE INVENTION

1. Field of the Invention

The present invention relates to illuminated pacifiers and more particularly pertains to a new Air Responsive Illuminated Pacifier for providing a pacifier having a light source which is activated when an child sucks on the pacifier.

2. Description of the Prior Art

The use of illuminated pacifiers is known in the prior art. More specifically, illuminated pacifiers heretofore devised and utilized are known to consist basically of familiar, expected and obvious structural configurations, notwithstanding the myriad of designs encompassed by the crowded prior art which have been developed for the fulfillment of countless objectives and requirements.

Known prior art illuminated pacifiers include U.S. Pat. No. 4,716,902; U.S. Pat. No. 4,688,571; U.S. Pat. No. D335,929; U.S. Pat. No. 5,007,924; U.S. Pat. No. 4,228,484; and U.S. Pat. No. D245,790.

While these devices fulfill their respective, particular objectives and requirements, the aforementioned patents do not disclose a new Air Responsive Illuminated Pacifier. The inventive device includes an airtight nipple portion, a handle portion attached to the nipple portion, and a light source and a pressure actuated switch positioned within the handle portion, wherein the switch activates the light source when a child sucks on the nipple portion.

In these respects, the Air Responsive Illuminated Pacifier according to the present invention substantially departs from the conventional concepts and designs of the prior art, and in so doing provides an apparatus primarily developed for the purpose of providing a pacifier having a light source which is activated when an child sucks on the pacifier.

SUMMARY OF THE INVENTION

In view of the foregoing disadvantages inherent in the known types of illuminated pacifiers now present in the prior art, the present invention provides a new Air Responsive Illuminated Pacifier construction wherein the same can be utilized for providing a pacifier having a light source which is activated when an child sucks on the pacifier.

The general purpose of the present invention, which will be described subsequently in greater detail, is to provide a new Air Responsive Illuminated Pacifier apparatus and method which has many of the advantages of the illuminated pacifiers mentioned heretofore and many novel features that result in a new Air Responsive Illuminated Pacifier which is not anticipated, rendered obvious, suggested, or even implied by any of the prior art illuminated pacifiers, either alone or in any combination thereof.

To attain this, the present invention generally comprises an airtight nipple portion, a handle portion attached to the nipple portion, and a light source and a pressure actuated switch positioned within the handle portion, wherein the switch activates the light source when a child sucks on the nipple portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Air Responsive Illuminated Pacifier apparatus and method which has many of the advantages of the illuminated pacifiers mentioned heretofore and many novel features that result in a new Air Responsive Illuminated Pacifier which is not anticipated, rendered obvious, suggested, or even implied by any of the prior art illuminated pacifiers, either alone or in any combination thereof.

It is another object of the present invention to provide a new Air Responsive Illuminated Pacifier which may be easily and efficiently manufactured and marketed.

It is a further object of the present invention to provide a new Air Responsive Illuminated Pacifier which is of a durable and reliable construction.

An even further object of the present invention is to provide a new Air Responsive Illuminated Pacifier which is susceptible of a low cost of manufacture with regard to both materials and labor, and which accordingly is then susceptible of low prices of sale to the consuming public, thereby making such Air Responsive Illuminated Pacifier economically available to the buying public.

Still yet another object of the present invention is to provide a new Air Responsive Illuminated Pacifier which provides in the apparatuses and methods of the prior art some of the advantages thereof, while simultaneously overcoming some of the disadvantages normally associated therewith.

Still another object of the present invention is to provide a new Air Responsive Illuminated Pacifier for providing a pacifier having a light source which is activated when an child sucks on the pacifier.

Yet another object of the present invention is to provide a new Air Responsive Illuminated Pacifier which includes an airtight nipple portion, a handle portion attached to the nipple portion, and a light source and a pressure actuated switch positioned within the handle portion, wherein the switch activates the light source when a child sucks on the nipple portion.

Still yet another object of the present invention is to provide a new Air Responsive Illuminated Pacifier that would feature a luminous handle portion which would glow beyond activation of the light source and enable a child or parent to easily locate the pacifier in the dark. As such, a parent can locate the pacifier without having to turn on a light and disturb the child.

Even still another object of the present invention is to provide a new Air Responsive Illuminated Pacifier that allows a parent to ascertain from a distance whether or not a child is sleeping. If a child is awake and sucking on the pacifier, the light source would emit a bright light. However, if the child is asleep, the handle portion would glow.

Even still another object of the present invention is to provide a new Air Responsive Illuminated Pacifier that offers a steady light source which is aesthetically pleasing and soothing to a child, possibly calming them and comforting them to sleep.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
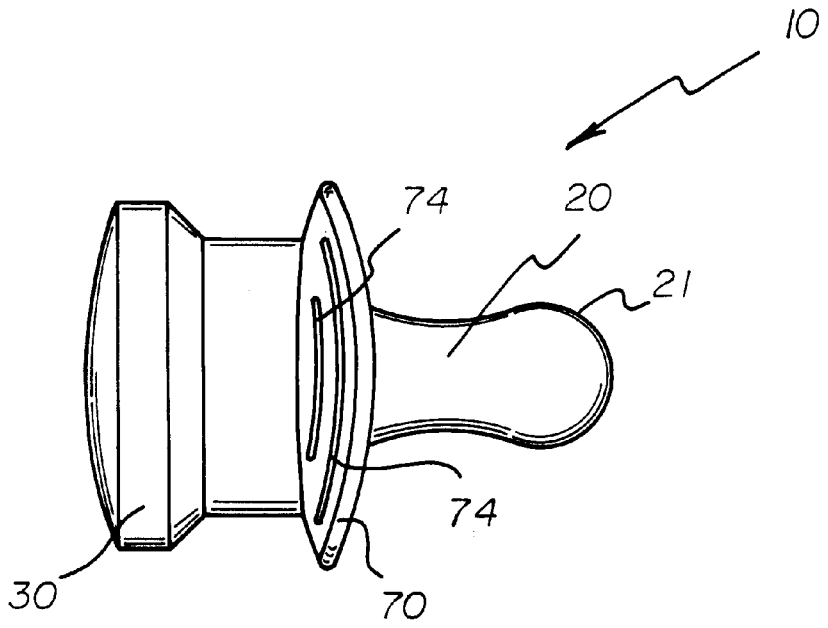
FIG. 1 is a side view of a new Air Responsive Illuminated Pacifier according to the present invention.

With reference now to the drawings, and in particular to FIGS. 1 through 6 thereof, a new Air Responsive Illuminated Pacifier embodying the principles and concepts of the present invention and generally designated by the reference numeral 10 will be described.

More specifically, it will be noted that the Air Responsive Illuminated Pacifier 10 comprises a nipple portion 20, a handle portion 30 attached to the nipple portion 20, a light source 40 positioned within and directed toward the handle portion 30 to illuminate the handle portion 30 when activated, a switching means 50 for activating the light source 40 when a child sucks on the nipple portion 20, and a power source 60 for powering the light source 40. The switching means 50 is actuatable by air pressure generated within the nipple portion 20 when a child sucks on the nipple portion 20.

Figure 4:
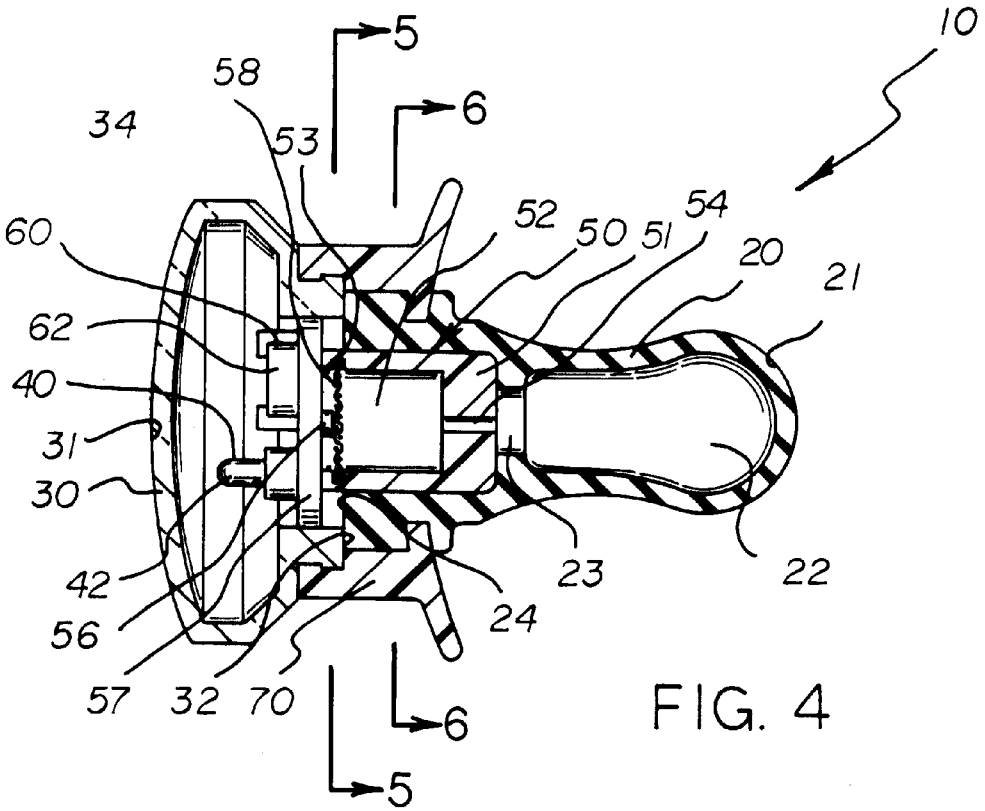
FIG. 4 is a cross sectional view taken along line 4—4 of FIG. 3.

As best illustrated in FIG. 4, it can be shown that the nipple portion 20 has a bulbous end 21 and an open end 24. The bulbous end 21 of the nipple portion 20 has a hollow interior chamber 22 therein. An orifice 23 is interposed between the bulbous end 21 and the open end 24 and provides communication between the hollow interior chamber 22 of the bulbous end 21 and the open end 24. The orifice 23 has a diameter smaller than that of the hollow interior chamber 22. The nipple portion 20 is made of soft plastic or rubber.

As best illustrated in FIG. 4, it can be shown that the handle portion 30 has a closed end 31 and an open end 32. A hollow interior cavity 34, provided within the handle portion 30, is open to the open end 32. The handle portion 30 is made of a translucent or luminescent material.

Figure 5:
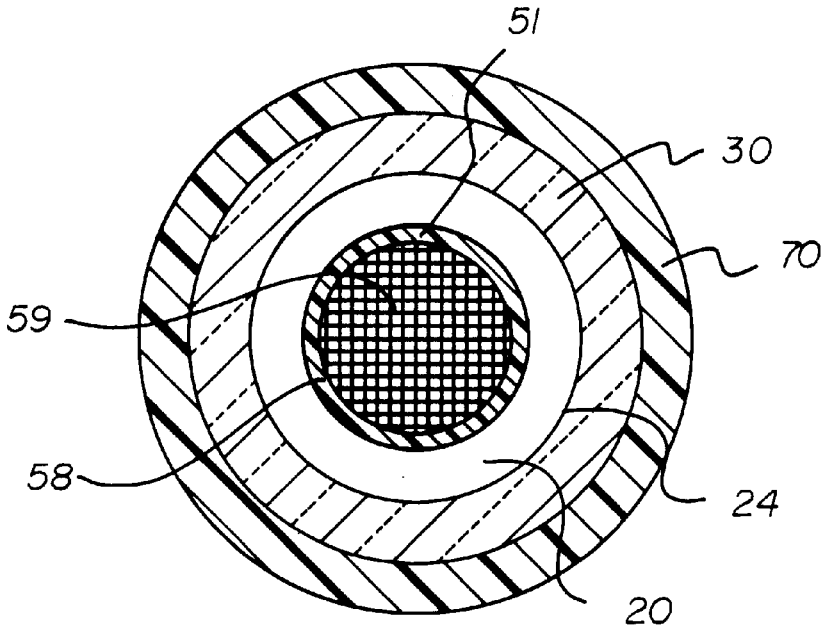
FIG. 5 is a cross sectional view taken along line 5—5 of FIG. 4.
Figure 6:
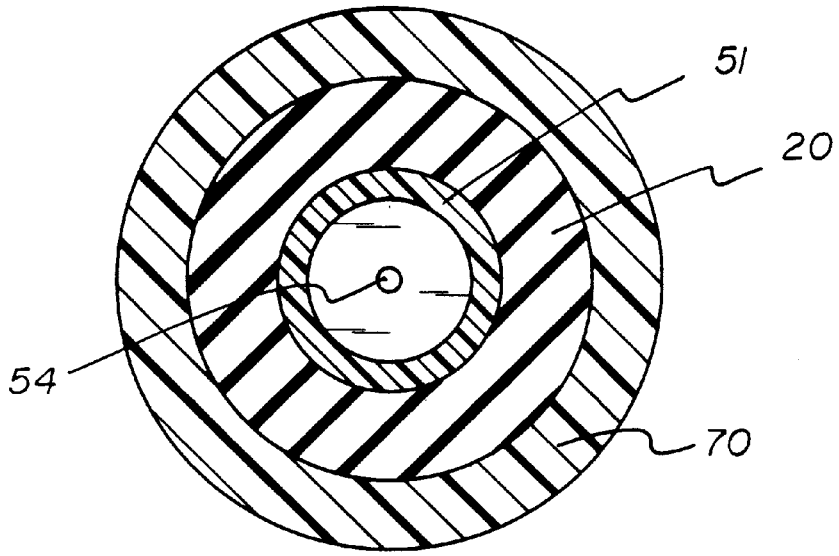
FIG. 6 is a cross sectional view taken along line 6—6 of FIG. 4.

As best illustrated in FIGS. 4 through 6, it can be shown that the switching means 50 comprises a plug 51 fitted within the open end 24 of the nipple portion 20 wherein the plug 51 has an opening 52 at one end and an air passage 54 at the other end whereby the opening 52 and the air passage 54 communicate, a contact switch 56 positioned within the opening 52 of the plug 51 for activating the light source 40, and a flexible contact member 58 positioned within the opening 52 of the plug 51 adjacent the contact switch 56 and interposed between the contact switch 56 and the air passage 54 of the plug 51 wherein the flexible contact member 58, when actuated, contacts the contact switch 56 thereby activating the light source 40. The plug 51 is fitted within the open end 24 of the nipple portion 20 such that an airtight seal is created between the plug 51 and the open end 24 and such that the air passage 54 of the plug 51 is adjacent to and communicates with the orifice 23 of the nipple portion 20. The air passage 54 of the plug 51 has a diameter substantially smaller than that of the opening 52 and smaller than that of the orifice 23 of the hollow interior chamber 22 of the nipple portion 20.

As best illustrated in FIGS. 4 through 6, it can be shown that the flexible contact member 58 fits within a groove 53 provided in the opening 52 of the plug 51. The flexible contact member 58 is a screen 59 made of a fine steel mesh which allows for slight leakage of air pressure therethrough. The contact switch 56 is mounted on one side of an end plate 57 which is mounted in the open end 32 of the handle portion 30 and sealingly attached to the plug 51 at the end of the opening 52 opposite the air passage 54. The contact switch 56 is electrically coupled to the light source 40 which is mounted on an opposite side of the end plate 57 and directed toward the handle portion 30 such that the light source 40 projects light into the hollow interior cavity 34. The light source 40 is a light emitting diode (LED) 42. The power source 60 is electrically coupled to the light source 40 and also mounted on the end plate 57. The power source 60 is an alkaline battery 62. The end plate 57 may be a circuit board to which the contact switch 56, the light source 40, and the power source 60 are mounted in the configuration mentioned above.

Figure 2:
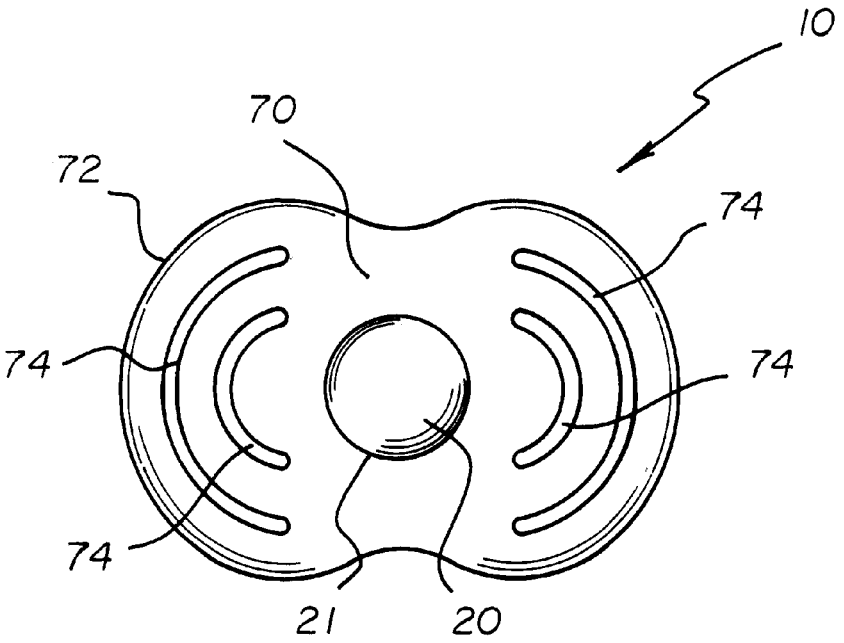
FIG. 2 is a front view of the present invention showing the nipple and shield portions thereof.
Figure 3:
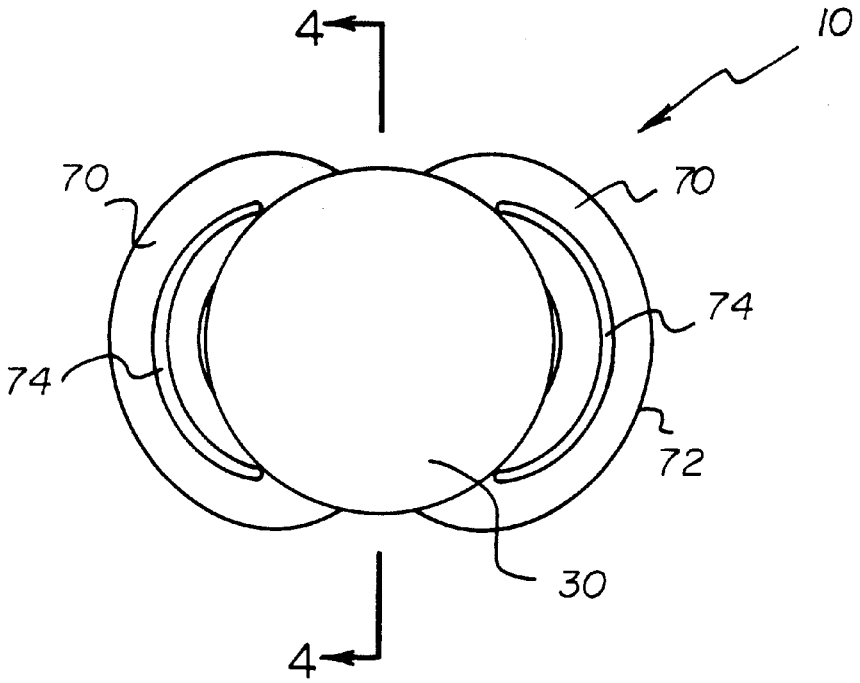
FIG. 3 is a rear view of the present invention showing the handle and shield portions thereof.

As best illustrated in FIGS. 1 and 2, it can be shown that a shield portion 70 may be provided intermediate the nipple portion 20 and the handle portion 30. The shield portion 70 is symmetrically located about the nipple portion 20 and extends radially outward from the nipple portion 20. The shield portion 70 is relatively thin and has an elliptical or circular-shaped periphery 72. In addition, the shield portion 70 may be contoured to fit against the mouth of a child. Aeration slots 74 are provided in the shield portion 70 to facilitate circulation of air between the face of the child and the shield portion 70.

In use, a child places the nipple portion 20 of the pacifier 10 in his or her mouth and sucks on the bulbous end 21. The sucking action of the child increases the air pressure within the hollow interior chamber 22. This increased air pressure is transferred through the orifice 23, through the air passage 54, and to the opening 52 of the plug 51. The resulting increased air pressure generated within the opening 52 of the plug 51 causes the flexible contact member 58 to bulge and contact the contact switch 56 thereby activating the light source 40. A single activation of the light source 40 causes the light source 40 to remain lit for a predetermined time (e.g., 15 seconds). When activated, the light source 40 emits light into the hollow interior cavity 34 of the handle portion 30. When the handle portion 30 is made of a luminescent material, the handle portion 30 continues to glow for a substantial time after extinguishment of the light source 40. The glowing handle portion 30 enables a child or parent to easily locate the pacifier 10 in the dark.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. An Air Responsive Illuminated Pacifier comprising:

a nipple portion;

a handle portion attached to said nipple portion;

a light source positioned within and directed toward said handle portion, said light source illuminating said handle portion when activated;

a switching means interposed between said nipple portion and said handle portion for activating said light source, said switching means actuatable by air pressure generated within said nipple portion when a child sucks on said nipple portion; and a power source positioned within said handle portion for powering said light source.

2. An Air Responsive Illuminated Pacifier comprising:

a nipple portion having a bulbous end, an open end, and an orifice interposed therebetween, said bulbous end having a hollow interior chamber therein, said orifice providing communication between said hollow interior chamber and said open end;

a handle portion having a closed end and an open end, said handle portion having a hollow interior cavity therein, said hollow interior cavity open to said open end of said handle portion;

a light source positioned within and directed toward said handle portion, said light source illuminating said handle portion when activated;

a plug sealingly fitted within said open end of said nipple portion, said plug having an opening at one end and an air passage at another end wherein said air passage communicates with said opening, said air passage of said plug adjacent and communicating with said orifice of said nipple portion;

an end plate mounted in said open end of said handle portion, said end plate sealingly closing said opening of said plug opposite said air passage;

a contact switch positioned within said opening of said plug for activating said light source;

a flexible contact member positioned within said opening of said plug adjacent said contact switch, said flexible contact member interposed between said contact switch and said air passage of said plug, whereby when a child sucks on said bulbous end of said nipple portion, air pressure within said hollow interior chamber of said nipple portion is increased and transferred through said orifice of said nipple portion, through said air passage of said plug, and to said opening of said plug thereby causing said flexible contact member to bulge and contact said contact switch thereby activating said light source; and a power source positioned within said handle portion for powering said light source.

3. The Air Responsive Illuminated Pacifier of claim 2, wherein said orifice of said nipple portion has a diameter smaller than the diameter of said hollow interior chamber of said nipple portion.

4. The Air Responsive Illuminated Pacifier of claim 2, wherein said air passage of said plug has a diameter substantially smaller than the diameter of said opening of said plug.

5. The Air Responsive Illuminated Pacifier of claim 2, wherein said air passage of said plug has a diameter smaller than the diameter of said orifice of said nipple portion.

6. The Air Responsive Illuminated Pacifier of claim 2, wherein a groove is provided in said opening of said plug and wherein said flexible contact member is fitted within said groove.

7. The Air Responsive Illuminated Pacifier of claim 2, wherein said flexible contact member is a screen made of a fine steel mesh, said fine steel mesh allowing for slight leakage of air pressure therethrough.

8. The Air Responsive Illuminated Pacifier of claim 2, wherein said contact switch is mounted on one side of said end plate toward said opening of said plug and wherein said light source and said power source are mounted on an opposite side of said end plate.

9. The Air Responsive Illuminated Pacifier of claim 2, wherein said end plate is a circuit board to which said contact switch, said light source, and said power source are mounted and electrically coupled thereamong.

10. The Air Responsive Illuminated Pacifier of claim 2, wherein said power source is an alkaline battery.

11. The Air Responsive Illuminated Pacifier of claim 2, wherein said light source is a light emitting diode.

12. The Air Responsive Illuminated Pacifier of claim 1 or claim 2, wherein said handle portion is made of a translucent material.

13. The Air Responsive Illuminated Pacifier of claim 1 or claim 2, wherein said handle portion is made of a luminescent material whereby said handle portion continues to glow after extinguishment of said light source.

14. The Air Responsive Illuminated Pacifier of claim 1 or claim 2, further comprising a shield portion provided intermediate said nipple portion and said handle portion, said shield portion symmetrically located about said nipple portion and extending radially outward from said nipple portion.

15. The Air Responsive Illuminated Pacifier of claim 14, wherein said shield portion is contoured to fit against the face of a child and wherein an aeration slot is provided in said shield portion to facilitate circulation of air between the face of a child and said shield portion.

* * * * *